United States Patent [19]

Longwell et al.

[11] 4,409,094

[45] Oct. 11, 1983

[54] PROCESS FOR DETOXIFYING COAL TARS

[75] Inventors: John P. Longwell, Cambridge; William A. Peters, Arlington, both of Mass.

[73] Assignee: Massachusetts Institute of Technology, Cambridge, Mass.

[21] Appl. No.: 176,580

[22] Filed: Aug. 8, 1980

[51] Int. Cl.[3] ..... C10G 11/04

[52] U.S. Cl. ..... 208/121; 201/29; 208/44; 208/106; 208/126; 208/127; 208/226; 208/259; 208/283; 208/299; 423/230; 585/653

[58] Field of Search ..... 208/106, 127, 121, 107-108, 208/226, 283, 146, 259, 299, 44; 585/653; 201/29; 423/230, 245

[56] References Cited

U.S. PATENT DOCUMENTS

| | | | |
|---|---|---|---|
| 1,429,992 | 9/1922 | Woegerer | 208/121 |
| 1,434,300 | 10/1922 | Lightenhome | 208/121 |
| 2,034,712 | 3/1936 | Dolbear | 208/283 X |
| 2,288,613 | 7/1942 | Dill | 208/176 X |
| 2,348,543 | 5/1944 | Johnson | 208/226 |
| 2,348,745 | 5/1944 | Moriarity | 208/226 |
| 2,364,390 | 12/1944 | Schaafsma | 208/226 |
| 2,886,513 | 5/1959 | Baker | 208/121 |
| 2,970,956 | 2/1961 | Shiah | 208/226 |
| 3,027,415 | 3/1962 | Steinhofer et al. | 208/121 X |
| 3,707,472 | 12/1972 | Moss | 208/127 |
| 3,743,593 | 7/1973 | Saxton | 208/55 |
| 3,767,567 | 10/1973 | Tomita et al. | 208/122 |
| 3,849,298 | 11/1974 | Funakubo et al. | 208/310 |
| 4,042,487 | 8/1977 | Seguchi et al. | 208/85 X |
| 4,087,348 | 5/1978 | Baird et al. | 208/108 |
| 4,093,536 | 6/1978 | Heckelsberg | 208/121 |
| 4,305,809 | 12/1981 | Chen et al. | 208/127 |

*Primary Examiner*—Delbert E. Gantz
*Assistant Examiner*—G. E. Schmitkons
*Attorney, Agent, or Firm*—Arthur A. Smith, Jr.; George W. Neuner

[57] ABSTRACT

A process for treating liquid hydrocarbons to remove toxic, mutagenic and/or carcinogenic aromatic hydrocarbons comprises feeding the hydrocarbons into a reactor where vapors are thermally treated in contact with a catalyst consisting essentially of calcium oxide or a calcium oxide containing mineral. Thermally treating liquid hydrocarbons in contact with calcium oxide preferentially increases the cracking of aromatics thus producing a product having a reduced amount of aromatic compounds.

11 Claims, 1 Drawing Figure

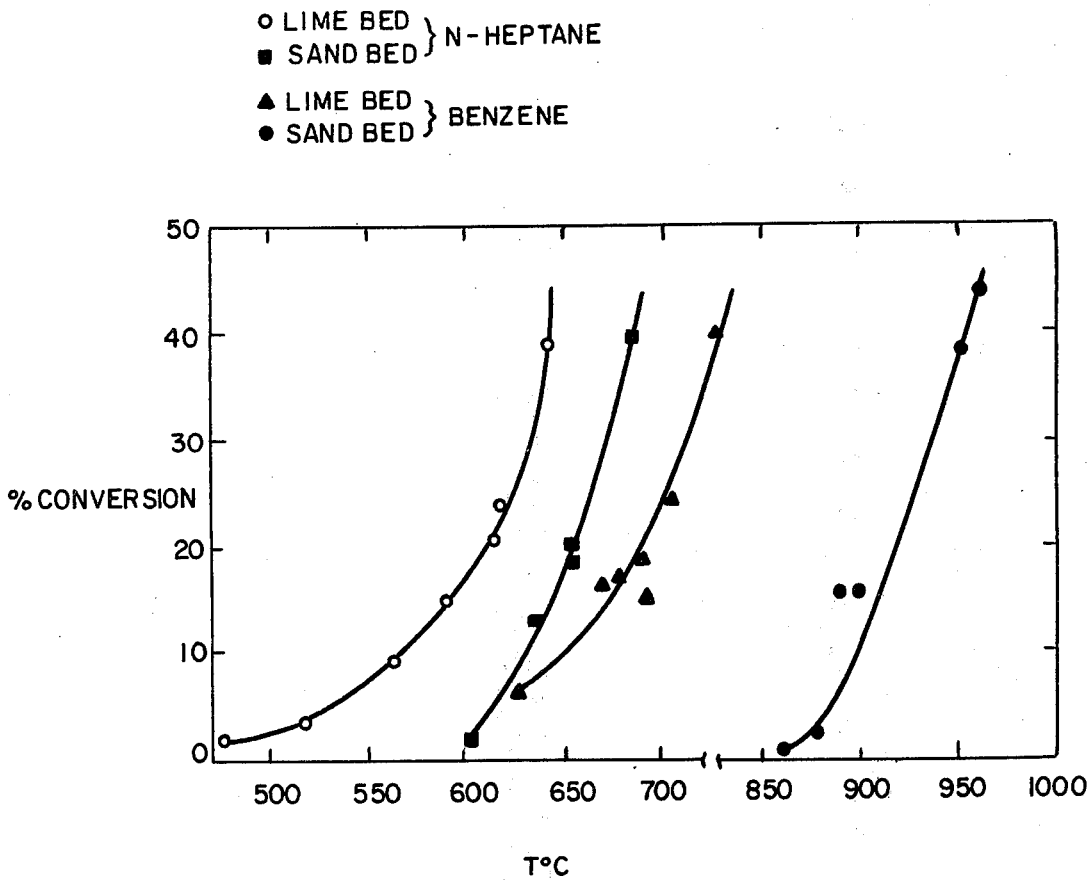
o LIME BED
■ SAND BED
N-HEPTANE
▲ LIME BED
● SAND BED
BENZENE
% CONVERSION
50
40
30
20
10
0
500
550
600
650
700
850
900
950
1000
T°C

PROCESS FOR DETOXIFYING COAL TARS

The Government has rights in this invention pursuant to Contract Number DE-FG22-80PC30299 awarded by the U.S. Department of Energy.

FIELD OF THE INVENTION

The present invention relates to the processing of hydrocarbons in the presence of inorganic oxides and more particularly to the treatment of coal tar liquids and like products in the presence of calcium oxide or dolomitic stones.

BACKGROUND OF THE INVENTION

The continual tightening of the world energy supply along with the associated rise in energy costs has brought about a search for alternative energy sources other than the preferred fuels, oils and gas. The most abundant alternative hydrocarbon energy sources in North America are coal, oil shale, and tar sands. These alternative energy sources each have certain problems associated with them. For instance, much of the coal supply in the United States, particularly the eastern regions, are low grade high sulfur coals. The combustion of massive quantities of sulfur is known to cause significant damage to crops, human health, etc. As such, Federal environmental protection laws limit the use of such fuels in large scale operations such as power plants. As the supply of preferred fuels dwindles more and more, economic pressure will force the low grade high sulfur coals into the forefront of the energy market. Oil shale and tar sands have substantial amounts of high molecular weight hydrocarbons, are more difficult to extract and require more processing than crude oil to obtain products similar to present petroleum distillates.

In order to obtain an environmentally clean fuel from coal it has been proposed to pyrolyze it and produce gas which can be cleared of sulfur and transmitted by pipeline to end users, and to produce coal tar liquids which contain aromatic and polynuclear aromatic compounds. We have found that these coal tar liquids are toxic to *S. typhimurium* and are potentially mutagenic. It would be highly desirable to treat these tars to detoxify them and eliminate or lessen their potential for mutagenicity, thus making them less hazardous to handle and use.

In addition, the coal tars, oil shale and tar sands hydrocarbons require considerable upgrading to be useful as, for example, middle distillates. More efficient and more economical processes for upgrading these hydrocarbons are constantly being sought.

SUMMARY OF THE INVENTION

We have found that the potential for mutagenicity of coal tar liquids and the like can be lessened by contacting them at elevated temperatures with material consisting essentially of calcium oxide or calcium oxide-containing minerals, such as dolomitic stones.

In addition we have found that the rate of thermal cracking of aromatic and polynuclear aromatic hydrocarbons can be preferentially increased compared to the rate for cracking aliphatic hydrocarbons by contacting them with a material consisting essentially of calcium oxide or calcium oxide containing minerals at elevated temperatures. This is, indeed, surprising because aliphatic hydrocarbons are known to be much less stable than aromatic hydrocarbons.

As used herein the term "hydrocarbon" or "aromatic hydrocarbon" includes to both mononuclear and polynuclear aromatic compounds which may contain hereto atoms such as sulfur, nitrogen and oxygen. Further, the term "detoxify" as used herein refers to the elimination or reduction of toxicity, mutagenicity and/or carcinogenicity.

BRIEF DESCRIPTION OF THE DRAWINGS

The FIGURE is a graph illustrating the effects of thermal treating of benzene and n-heptane over lime in comparison with treating over sand at various temperatures.

DESCRIPTION OF THE INVENTION

When hydrocarbons are cracked, either thermally or catalytically, aromatic compounds are usually concentrated due to the higher rate of cracking of paraffins and napthenes. In some cases, this is desirable; however, there are many circumstances where removal of aromatics is desirable. An example is in refining petroleum or synthetic fuel oils that contain aromatic hydrocarbons that may be toxic, mutagenic, and/or carcinogenic.

The radical chemistry of aromatics is different from that of aliphatic compounds in a number of respects. The important difference being the stability of aromatic radicals. The free radical electron is stabilized by the pi electron cloud in aromatic systems. As a result of this stability, aromatic radicals are more selective (less reactive) and tend to form more stable products. The only more stable products than aromatics are other polynuclear aromatics. This fact describes a general tendancy of all unsubstituted aromatics to form polynuclear aromatics at pyrolysis conditions.

Because unsaturated radical species tend to be more stable than saturated radicals, undoubtedly due to the delocalization of the free electron, a more selective radical is produced. Only propagation processes that result in more stable radicals will occur appreciably. Thus the tendency to form stable aromatics can be seen, because they are the stablest unsaturated compounds. Mononuclear aromatics in turn can further react with olefins in condensation reactions to form polynuclear aromatics and eventually coke.

The chemistry of lime, until recently, consisted mainly of reactions of interest to the cement industry. The kinetics and thermodynamics of relatively few of these reactions have been published. The catalytic activity and properties of lime are just beginning to be explored. The porous structure of lime makes it well suited for a catalyst, although the specific surface area is fairly low compared to other synthetic catalysts. Recent studies have shown CaO to catalyze the dehydrogenation and isomerization of olefins. Alcohols are known to dehydrogenate to aldehydes and ketones as well as dehydrate to olefins catalytically over lime. In addition, styrene is known to polymerize over CaO.

Hydrocarbons have been treated in the presence of lime or synthetic catalysts comprising calcium oxide as one component thereof in various processes. Examples of such processes include those disclosed in, for example, U.S. Pat. Nos. 1,429,992; 1,434,300; 2,886,513; 2,970,956; 3,027,415; and 3,767,567. Thermal reactions involving calcium oxide and mixtures of organic compounds formed the basis for processes that use lime and related additives to sweeten sour crude oils. Removal of significant amounts of mercaptans as well as reduction in total sulfur have been reported for straight run and cracked gasoline and visbreaker distillates. Production of light oils by adding lime to kerosine followed by steam atomizing/distillation and reaction at temperatures as low as 120° C. was patented as early as 1922 (U.S. Pat. No. 1,429,992 supra).

However, to our knowledge, no one has reported the use of calcium oxide to detoxify coal tars or the like or to selectively crack mononuclear and polynuclear aromatic hydrocarbons prior to the present invention. In view of the known chemistry, the tendency of lime to increase the cracking of aromatics in preference to paraffins is indeed surprising and unexpected.

Thus, in accord with our invention, lime or minerals comprising lime are used to reduce the relative amounts of aromatic hydrocarbons in liquid hydrocarbon fuels and to remove undesirable toxic, mutagenic and/or carcinogenic mononuclear and polynuclear aromatics. The catalyst consisting essentially of calcium oxide or a calcium oxide mineral such as dolomite stones is contacted in a reaction vessel by the hydrocarbon vapors for a time period sufficient to eliminate or reduce the toxicity, mutagenicity or carcinogenicity of the product to the desired extent and/or to upgrade the quality of the hydrocarbon by reducing the relative proportion of aromatic hydrocarbons by the desired amount. The reaction products can be separated from unreacted hydrocarbon and/or catalyst. Unreacted hydrocarbon may then be recirculated. Spent catalyst is regenerated by removing the coke through combustion and/or gasification and the regenerated catalyst returned to the reaction vessel. Well known refinery process techniques are used for all materials handling and separation.

Preferably, the reaction vessel consists of a fixed bed or fluid bed reactor. A feed stream of tar or liquid derived from, for instance, coal, oil shale, petroleum, or tar sands, is introduced into the reaction vessel which is maintained at a suitable preselected temperature and pressure. The feed stream can be pumped directly into the reaction vessel where it is vaporized upon contact with the catalyst bed or it can be entrained in a stream of carrier gas consisting of steam or process recycle gas, or the like, where it undergoes partial or entire vaporization before entering the reaction vessel.

The reactor vessel temperature and pressure, and the residence time of the hydrocarbons in the vessel can be varied depending upon the particular make-up of the feed stream and the desired reaction products. Typically the hydrocarbon vapors will be contacted with the calcium oxide for from about 0.1 to about 10 seconds, the reactor bed temperature will be maintained at from about 400° C. to 1000° C. under a total pressure of from about 1 to about 100atmospheres. Preferably, the mean residence time of the hydrocarbons will be from about 0.5 to about 2 seconds at a bed temperature of from about 500° C. to about 800° C. under a total pressure of from about 2 to about 20 atmospheres.

The partially reacted calcium oxide or calcium oxide-containing minerals will contain coke and carbon deposits which must be removed to maintain the cracking activity and selectivity for aromatic compounds described above. This coke removal can be accomplished in any of a number of well known methods for regenerating catalyst used in thermal treating of hydrocarbons. For instance, a continuous process can be used in which a portion of the coked calcium oxide or calcium oxide-containing mineral is circulated to a second vessel wherein it is contacted with air, oxygen or other reactive gas or gaseous mixture at a sufficiently high temperature that the coke and carbon is removed by combustion or gasification. Also a batch type or cyclical process can be used in which a reactive gas or gaseous mixture as described above for the continuous process is periodically passed through a fixed or moving or other bed of the coked calcium oxide or calcium oxide-containing mineral, and the temperature of that bed is maintained sufficiently high that the coke and carbon is removed by combustion or gasification A packed bed tubular reactor was used for pilot runs. The physical dimensions of the packed bed were varied depending on the temperature, reactor pressure and mean residence time desired. The beds ranged from 100 mm to 150 mm in length and 7 mm to 15 mm in diameter. The smaller beds were used for low temperature or low residence time work, the larger ones for higher temperature or longer residence times All reactor tubes were constructed from 99.9% pure quartz with a wall thickness of 1 mm. Quartz was chosen for the tube because of its excellent high temperature properties and its chemical inertness.

The tube diameter of the packed bed section of the reactor was always larger than the entrance and exit tubes. The purpose of this was 2-fold. First this design permitted facile bed packing and removal since only 2 quartz wool plugs were required to secure the bed. Secondly, this design guarded against possible homogenous reaction occuring in the entrance and exit tubes by minimizing the residence time in these regions.

The reactor temperature was maintained by a Lindberg compact split tube furnace. This furnace was modified with separate additional heating elements to allow a uniform axial temperature profile over a minimum length of 150 mm. The packed bed reactor tube was centered in this furnace with cement molds designed for this purpose.

Temperature measurements were made with a chromel-alumel type K thermocouple connected to a digital multimeter. Measurements were always made axially in 25 mm increments over the entire length of the reactor, from bottom to top. Readings were taken immediately prior to a run, under the same carrier gas flow conditions of the run to be attempted.

The carrier gas used for the feed stream was helium. However, any other suitable gas, inert under the reaction conditions, can be used, for instance, recycle gas. The helium was of high purity (99.9+%), the major impurity present being methane. The carrier gas was passed through a U-tube trap. The trap was maintained at liquid nitrogen temperature (−196° C.) to condense out all volatile contaminants. This enabled an easier analysis of the reaction and of reaction products.

The carrier gas flow was regulated with a needle valve and monitored with a Gilmont rotometer at ambient conditions. The carrier gas exiting the rotometer would enter a tubular pre-heater which would raise the gas temperature in excess of 200° C.

The liquid feed was delivered via a 50 μl or 100 μl syringe driven by a Sage syringe pump model 341. The syringe was inserted into the hot carrier gas stream through a silicone rubber no-air stopper mounted on a 7 mm O.D. piece of pyrex glass tubing. The stopper and tubing were secured in a ⅜" tee (Cajon fittings) with compression seals that insured a leak tight connection. The flow of the hot carrier gas past the syringe immediately evaporated the liquid reactant and carried it upstream at a uniform rate. This procedure for feeding the reactor was used for pilot runs to avoid local concentrating of hydrocarbons in the reactor bed. However, it will be readily appreciated that the liquid feed stream can be pumped directly into the reaction vessel.

The vaporized reactants proceeded upwards toward the packed bed, which was approximately 25 cm. from the point of insertion of the syringe. This 25 cm. space between the injection port and the packed bed allowed thorough mixing of the reactants to occur. The mixing was experimentally confirmed by visual inspection of coke deposits on the beds. The radial uniformity of such deposts implied a uniform mixture. All tubing exposed to volatile reactants was maintained at a minimum of 150° C. using electrical heating tapes to prevent condensation losses.

The packed bed itself was sandwiched between 12.5 mm plugs of quartz wool in the reactor tube previously described. The quartz wool was found to be inert, as previously noted. The gaseous reactant would react over the solid bed at the previously measured temperature. The heats of reaction at these conditions were not significant enough to alter the system temperature due to the high thermal capacitance of the bed and the carrier gas.

Upon exiting the bed the reaction products and unreacted starting material passed through a heated (<200° C.) pyrex tube and into a porapak QS trap cooled in a liquid nitrogen bath. The arms of the pyrex trap were heated with electrical heating tape to prevent condensation losses. Helium carrier gas was passed through to vent and the product gases, except for hydrogen, were trapped quantitatively on the lipophilic sorbent. Mass balances in excess of 95% were consistently achieved with both volatile and high boiling compounds.

In order to evaluate the action of calcium oxide in treating tars, pure benzene and n-heptane were turn through the above pilot equipment using beds of sand and lime at various temperatures. The effects of calcium oxide on the thermal decomposition of benzene and of n-heptane are shown in the FIGURE.

The data in the FIGURE were obtained by passing vapor of the indicated compound at a 5±1% (V/V) concentration in helium over a packed bed of 335–425 μm particles of either sand or lime. The "average" (V/F) residence time in contact with the stone was one second, and the temperature range for such compound was chosen to allow conversions ranging from near zero to about 50% to be studied. The data show that the thermal decomposition of benzene was significantly accelerated by lime compared to sand, while only a comparatively modest cracking rate increase was observed n-heptane. This change in normal cracking reactivity is surprising and unexpected.

The standard coal tar by-product of pyrolysis and the product of coal tar liquids reacted over calcium oxide were tested for mutagenicity using the bacterial cell gene locus mutation assay described in Skopek et al. Proc. Nat Acad. Sci U.S.A. 75 410 (1978) and Skopek et al., Proc. Nat Acad. Sci. U.S.A. 75 4470 (1978), which are hereby incorporated by reference. Neither of the liquids, whether treated with lime or untreated, showed mutagenic tendencies without activation. However, upon activation with post-mitochondrial supernatant (PMS), the untreated coal tar liquid was mutagenic whereas the coal tar liquid treated over lime remained non-mutagenic.

The invention has been described in full along with the preferred embodiments thereof. However, it will be appreciated that those skilled in the art, upon reading this disclosure, may make modifications and improvements within the spirit and scope of our invention.

We claim:

1. A process for treating hydrocarbon coal tar liquid containing toxic, mutagenic and/or carcinogenic aromatic compounds, said process comprising feeding said coal tar liquid into a reactor vessel, which is maintained at a temperature in the range of from about 400° C. to about 1000° C., where said coal tar liquid is present as a vapor and wherein said coal tar liquid is the only hydrocarbon fed into said reactor for treatment and no external hydrogen is added with the hydrocarbon feed, thermally treating said vapor in a reactor bed consisting essentially of a catalyst wherein said vapor is in intimate contact with said catalyst which consists essentially of calcium oxide or a calcium oxide-containing mineral, thereby removing at least some of said aromatic compounds and rendering said coal tar liquid less hazardous to the health of those handling it.

2. The process of claim 1 wherein said coal tar liquid is, or is derived from, coal tar, oil shale, petroleum bottoms, or tar sands.

3. The process of claim 1 wherein said catalyst is calcined dolomitic stones.

4. The process of claim 1 wherein said reactor vessel is maintained at a pressure of from about 1 to about 100 atmospheres and said vapors have a mean residence time of from about 0.1 to about 10 seconds.

5. The process of claim 1, further including the step of removing at least some of catalyst and replacing it with fresh or regenerated catalyst to reduce coke buildup on the catalyst.

6. The process of any one of claims 1, 2, 3 or 5 wherein said reactor vessel is maintained at a temperature of from about 500° C. to 800° C. under a pressure of from about 2 to about 20 atmospheres and said vapors have a mean residence time of from about 0.5 to about 2.0 seconds.

7. A process for reducing the amount of aromatic compounds in a coal tar liquid hydrocarbon, said process comprising feeding said coal tar liquid into a reactor vessel, which is maintained at a temperature in the range of from about 400° C. to about 1000° C., where said coal tar liquid is present as vapor and wherein said coal tar liquid is the only hydrocarbon fed into said reactor for treatment and no external hydrocarbon is added with the hydrocarbon feed, thermally treating said vapor in a reactor bed consisting essentially of a catalyst wherein said vapor is in intimate contact with said catalyst which consists essentially of calcium oxide or a calcium oxide-containing mineral, thereby preferentially increasing the cracking of said aromatic compounds.

8. The process of claim 7 wherein said catalyst is dolomitic stones.

9. The process of claim 7 wherein said reactor vessel is maintained at a pressure of from about 1 to about 400 atmospheres and said vapors have a mean residence time of from about 0.1 to about 10 seconds.

10. The process of claim 7, further including the step of removing at least some of catalyst and replacing it with fresh or regenerated catalyst to reduce coke buildup on the catalyst.

11. The process of any one of claims 7, 8 or 10 wherein said reactor vessel is maintained at a temperature of from about 500° C. to 800° C. under a pressure of from about 2 to about 20 atmospheres and said vapors have a mean residence time of from about 0.5 to about 2.0 seconds.

* * * * *